US010213078B2

(12) United States Patent
Kim et al.

(10) Patent No.: US 10,213,078 B2
(45) Date of Patent: Feb. 26, 2019

(54) VACUUM CLEANER

(71) Applicant: Samsung Electronics Co., Ltd., Suwon-si, Gyeonggi-do (KR)

(72) Inventors: Shin Kim, Hwaseong-si (KR); Sok-won Paik, Yongin-si (KR); Won-kyu Lim, Suwon-si (KR); Jae-min Lee, Suwon-si (KR); Hyun-ju Lee, Suwon-si (KR); Young-sung Jung, Yongin-si (KR); Jung-su Ha, Osan-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/357,260

(22) Filed: Nov. 21, 2016

(65) Prior Publication Data

US 2017/0143175 A1 May 25, 2017

(30) Foreign Application Priority Data

Nov. 19, 2015 (KR) ..... 10-2015-0162319

(51) Int. Cl.

| | |
|---|---|
| ***A47L 9/04*** | (2006.01) |
| ***A47L 5/34*** | (2006.01) |
| ***A47L 5/36*** | (2006.01) |
| ***A47L 5/30*** | (2006.01) |

(52) U.S. Cl.

CPC ..... *A47L 9/0494* (2013.01); *A47L 5/30* (2013.01); *A47L 5/34* (2013.01); *A47L 5/362* (2013.01); *A47L 9/0411* (2013.01); *A47L 9/0477* (2013.01)

(58) Field of Classification Search

CPC . A47L 9/0494; A47L 5/30; A47L 5/34; A47L 5/362; A47L 9/0411; A47L 9/0477

See application file for complete search history.

(56) References Cited

U.S. PATENT DOCUMENTS

| | | | | | |
|---|---|---|---|---|---|
| 1,607,500 | A * | 11/1926 | Agar | A47L 11/18 | 15/52.1 |
| 1,900,889 | A * | 3/1933 | Becker | A47L 5/34 | 15/384 |
| 2,651,803 | A * | 9/1953 | Browne | A47L 11/33 | 15/365 |
| 7,243,393 | B2 * | 7/2007 | Matusz | A47L 5/30 | 15/384 |
| 8,726,441 | B1 * | 5/2014 | Colasanti | A47L 11/33 | 15/41.1 |
| 8,910,340 | B2 * | 12/2014 | Bradbury | A47L 11/33 | 15/231 |

(Continued)

FOREIGN PATENT DOCUMENTS

| | | | |
|---|---|---|---|
| JP | 1995-079891 | A | 3/1995 |
| JP | 2001-157657 | A | 6/2001 |

(Continued)

*Primary Examiner* — Dung Van Nguyen
(74) *Attorney, Agent, or Firm* — Jefferson IP Law, LLP

(57) ABSTRACT

A nozzle assembly for a vacuum cleaner includes a driving member including a first driving shaft and a second driving shaft in both sides thereof, a first drum of which one end is coupled to the first driving shaft to be driven by directly receiving driving force of the first driving shaft, and a second drum of which one end is coupled to the second driving shaft to be driven by directly receiving driving force of the second driving shaft.

18 Claims, 13 Drawing Sheets

(56) References Cited

U.S. PATENT DOCUMENTS

| | | | |
|---|---|---|---|
| 2005/0015922 | A1 | 1/2005 | Lim et al. |
| 2012/0198644 | A1 | 8/2012 | Iles |

FOREIGN PATENT DOCUMENTS

| | | | |
|---|---|---|---|
| JP | 2001-231727 | A | 8/2001 |
| JP | 2007-167486 | A | 7/2007 |
| JP | 4893349 | B2 | 3/2012 |
| JP | 4985804 | B2 | 7/2012 |
| JP | 2013-102861 | A | 5/2013 |
| KR | 20-1998-0028329 | U | 8/1998 |
| KR | 10-1999-0003481 | A | 1/1999 |
| KR | 20-1999-0023960 | U | 7/1999 |
| KR | 10-2002-0057627 | A | 7/2002 |
| KR | 10-0480145 | B1 | 4/2005 |
| KR | 10-1116437 | B1 | 3/2012 |
| KR | 10-1475774 | B1 | 12/2014 |

* cited by examiner

VACUUM CLEANER

CROSS-REFERENCE TO RELATED APPLICATIONS

This application claims priority from Korean Patent Application No. 10-2015-0162319, filed on Nov. 19, 2015, in the Korean Intellectual Property Office, the disclosure of which is incorporated herein by reference in its entirety.

BACKGROUND OF THE INVENTION

Field of the Invention

Apparatuses and methods consistent with exemplary embodiments relate to a vacuum cleaner, and more particularly, to a vacuum cleaner capable of changing a position of a drum in which a brush is installed according to a type of surface to be cleaned and maximizing an area of the surface to be cleaned.

Description of the Related Art

In general, a vacuum cleaner may include a cleaner main body in which a vacuum suction device and a dust collector are installed and a nozzle assembly coupled to the main body. The nozzle assembly may suck the air including dirt through negative pressure formed in the vacuum suction device and divide the dirt from the air through the dust collector.

An agitator may be installed in the nozzle assembly in response to the surface to be cleaned such as carpet being often cleaned. This is because while the agitator rotates in a state that a plurality of brushes are implanted in a circumference of the agitator, the agitator hits the surface to be cleaned and disperses dust, and thus carpet cleaning may be effectively performed.

However, in response to a portion of the nozzle assembly in which the agitator is installed being in contact with a wall, the negative pressure for sucking the dirt may not act in a region close to the wall and thus the dust and dirt may not sucked.

SUMMARY OF THE INVENTION

Exemplary embodiments may overcome the above disadvantages and other disadvantages not described above. Also, an exemplary embodiment is not required to overcome the disadvantages described above, and an exemplary embodiment may not overcome any of the problems described above.

One or more exemplary embodiments relate to a vacuum cleaner capable of minimizing torque loss of a main brush provided in the vacuum cleaner.

One or more exemplary embodiments relate to a vacuum cleaner capable of improving dust suction performance around a wall.

One or more exemplary embodiments relate to a vacuum cleaner capable of maximizing torque of a brush by lifting up the brush according to a type of surface to be cleaned.

According to an aspect of an exemplary embodiment, there is provided a nozzle assembly for a vacuum cleaner including a driving member including a first driving shaft and a second driving shaft in both sides thereof; a first drum of which one end is coupled to the first driving shaft; and a second drum of which one end is coupled to the second driving shaft.

The first drum may have a first insertion groove which is concavely formed in a first coupling surface facing the driving member. The second drum may have a second insertion groove which is concavely formed in a second coupling surface facing the driving member. The first driving shaft may be inserted into the first insertion groove. The second driving shaft may be inserted into the second insertion groove.

The first driving shaft and the second driving shaft may have driving surfaces formed in outer circumferences thereof. The first insertion groove and the second insertion groove may have driven surfaces which are rotatably supported to the driving surfaces.

The first drum and the second drum may include main brushes installed in outer circumferences thereof; and auxiliary brushes installed in a first installation surface and a second installation surface arranged in opposite sides of the first coupling surface and the second coupling surface.

The nozzle assembly may further include a front housing which receives the driving member and the first drum and the second drum and has a suction port configured to suck the air in a bottom surface thereof; and side housings which close both opened side portions of the front housing.

The first and second installation surfaces may be spaced from the side housings at a preset interval.

The auxiliary brushes may be installed in central portions of the first and second installation surfaces and are obliquely arranged to protrude from the outer circumferences of the first drum and the second drum.

The nozzle assembly may further include a lifting member coupled to the driving member and configured to selectively lift up positions of the first drum and the second drum. The lifting member may include a pivot shaft disposed in parallel to an axis direction of the driving member; a supporting member configured to rotatably support the pivot shaft; and a connection member fixedly installed to the pivot shaft and the driving member.

According to an aspect of an exemplary embodiment, there is provided nozzle assembly for a vacuum cleaner including: a driving member; a pair of drums arranged in both sides of the driving member and configured to be rotated through driving force of the driving member; and a lifting member coupled to the driving member and configured to selectively lift up positions of the pair of drums.

The lifting member may include a pivot shaft disposed in parallel to an axis direction of the driving member; a supporting member configured to rotatably support the pivot shaft; and a connection member fixedly installed to the pivot shaft and the driving member.

The lifting member may further include a position regulating member having a seating surface in which a bottom surface of the connection member is placed and a supporting surface which is arranged over the seating surface to be spaced from the seating surface and is in contact with a top surface of the connection member.

An interval between the seating surface and the supporting surface may be larger than a thickness of the connection member.

The drum may be switched between a first position in which the bottom surface of the connection member is in contact with the seating surface and a second position in which the bottom surface of the connection member is in noncontact with the seating surface according to a type of surface to be cleaned.

The nozzle assembly may further include a housing which receives the driving member and the pairs of drums and has a suction port configured to suck the air in a bottom surface thereof. Each of the pair of drums may include an auxiliary brush installed in one surface arranged in an opposite side of the driving member.

The housing may further include a front housing has a suction port and has a both-side opened cylindrical shape; and side housings installed in both sides of the front housing, wherein the one surfaces of the pair of drums are arranged to be spaced from inner surfaces of the side housings at a preset interval.

The auxiliary brush may be installed in a central portion of the one surface of the drum and is obliquely arranged to protrude from an outer circumference of the drum.

Each of the pair of drums may have a supporting projection which is formed to protrude in the central portion of the one surface of the drum, and each of the side housings may have an elongated supporting groove which the supporting projection is inserted thereinto and corresponds to a lifting direction of the drum.

Each of the side housings may have a supporting projection which is formed to protrude from the inner surface of the side housing, and each of the pairs of drums may have an elongated supporting groove, which the supporting projection is inserted thereinto and corresponds to a lifting direction of the drum, in the central portion of the one surface of the drum.

One end portion of the auxiliary brush may be installed in the drum and the other end portion of the auxiliary brush may have a larger cross-section area than the one end portion of the auxiliary brush According to an aspect of an exemplary embodiment, there is provided a vacuum cleaner including a main body in which a dust collector is installed; a nozzle assembly; and a flexible hose which couples the main body and the nozzle assembly. The nozzle assembly may include a driving member; and a pair of drums coupled to both sides of the driving member to be driven through driving force of the driving member.

Additional aspects and advantages of the exemplary embodiments are set forth in the detailed description, and will be obvious from the detailed description, or may be learned by practicing the exemplary embodiments.

BRIEF DESCRIPTION OF THE DRAWING FIGURES

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Figure 1:
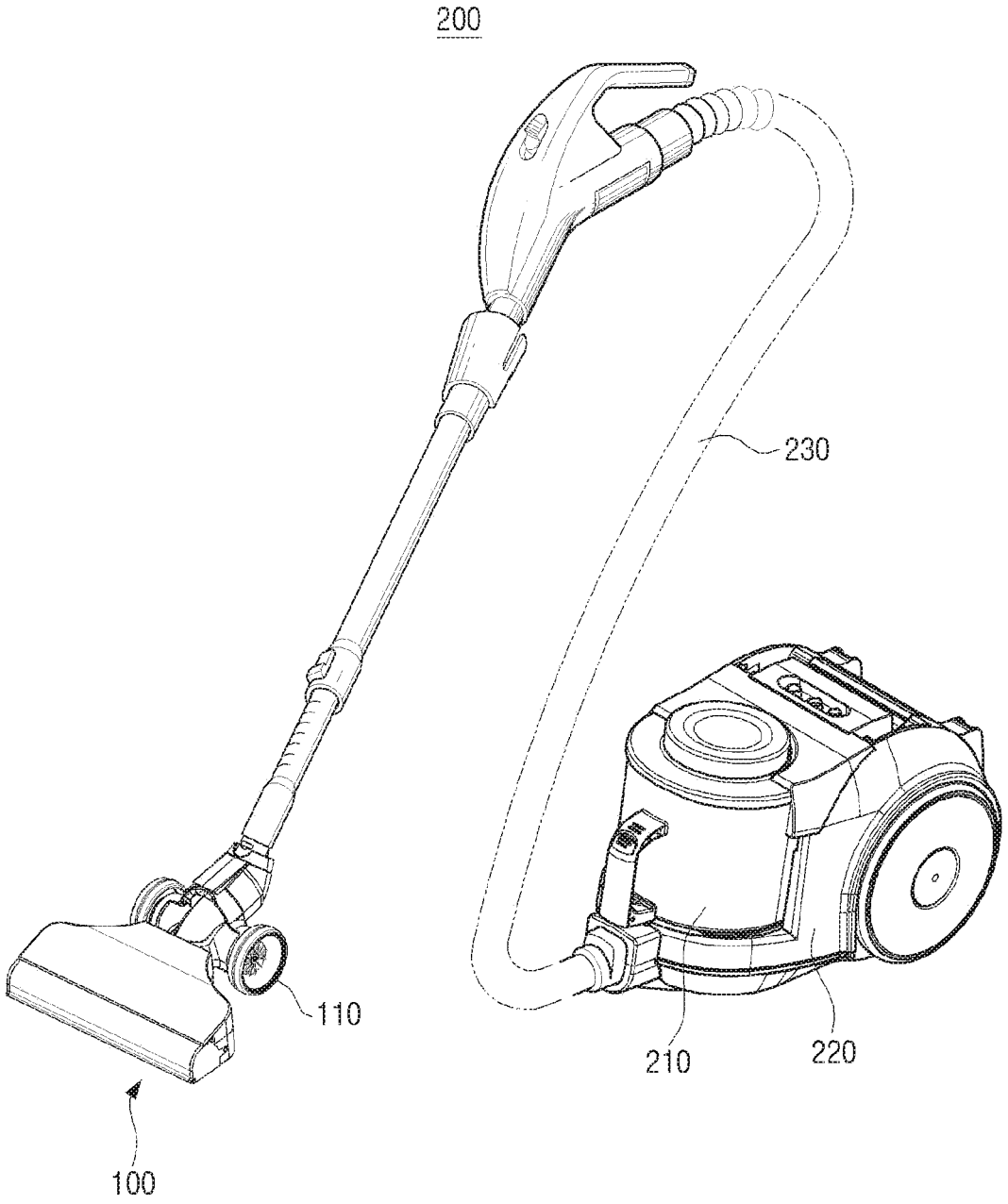
FIG. 1 is a schematic diagram illustrating a canister type cleaner according to an exemplary embodiment.

Hereinafter, the exemplary embodiments are described in greater detail with reference to the accompanying FIGS. 1 to 13. The matters defined in the description, such as detailed construction and elements, are provided to assist in a comprehensive understanding of the exemplary embodiments. Thus, it is understood that the exemplary embodiments can be carried out without those specifically defined matters.

Various embodiments will now be described more fully with reference to the accompanying drawings in which some embodiments are shown. The techniques described herein are exemplary, and should not be construed as implying any particular limitation on the present disclosure. It should be understood that various alternatives, combinations and modifications could be devised by those skilled in the art. In the following description, unless otherwise described, the same reference numerals are used for the same elements when they are depicted in different drawings.

FIG. 1 is a schematic diagram illustrating a canister type cleaner according to an exemplary embodiment. As illustrated in FIG. 1, a canister type cleaner 200 may include a main body 220 in which a vacuum suction motor (not shown) and a dust collector 210 are installed, a nozzle assembly 100, and a flexible hose 230 which couples the main body 220 and the nozzle assembly 100. A main wheel 110 may be installed in both rear-side ends of the nozzle assembly 100 and an auxiliary wheel (see 120 of FIG. 3) may be installed in both front-side ends of a bottom of the nozzle assembly 100.

Figure 2:
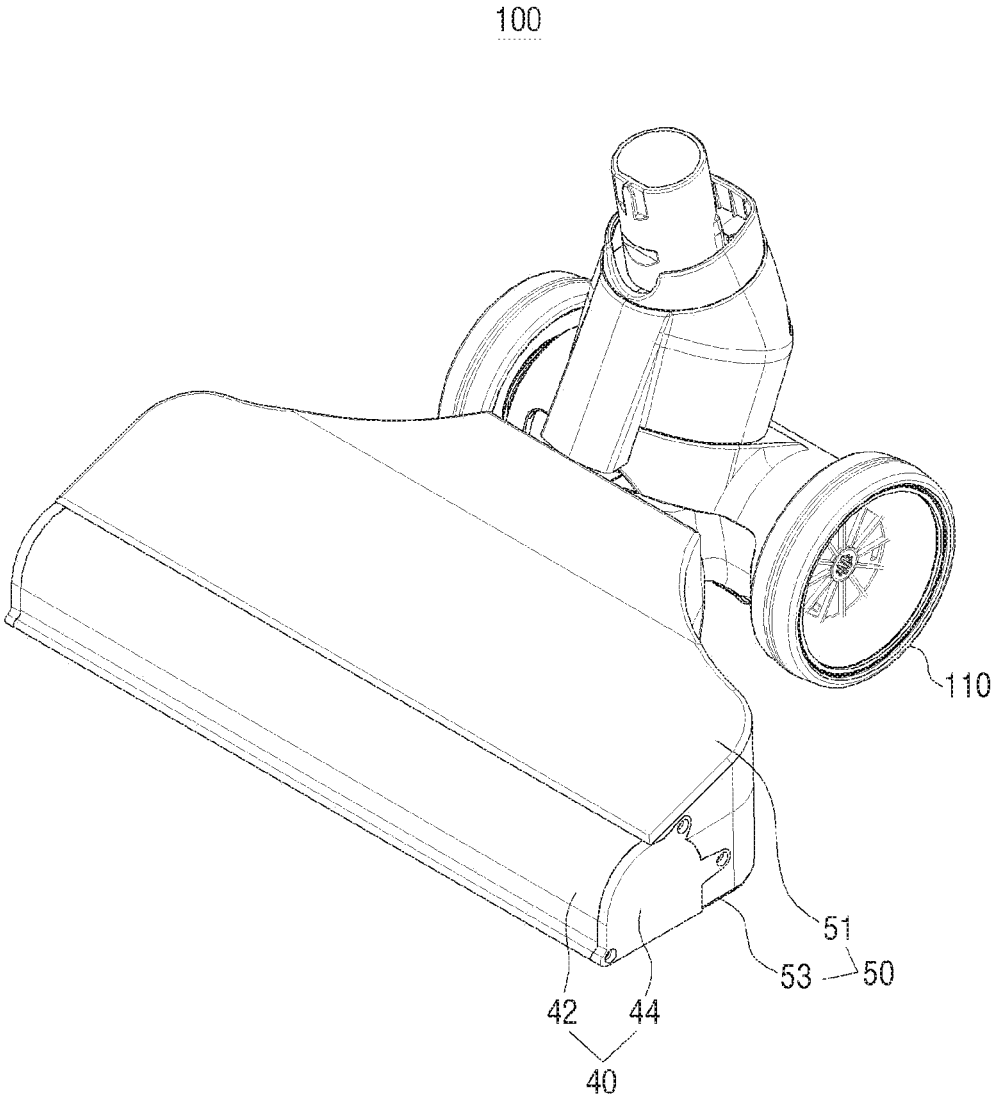
FIG. 2 is an enlarged view illustrating a nozzle assembly illustrated in FIG. 1.
Figure 3:
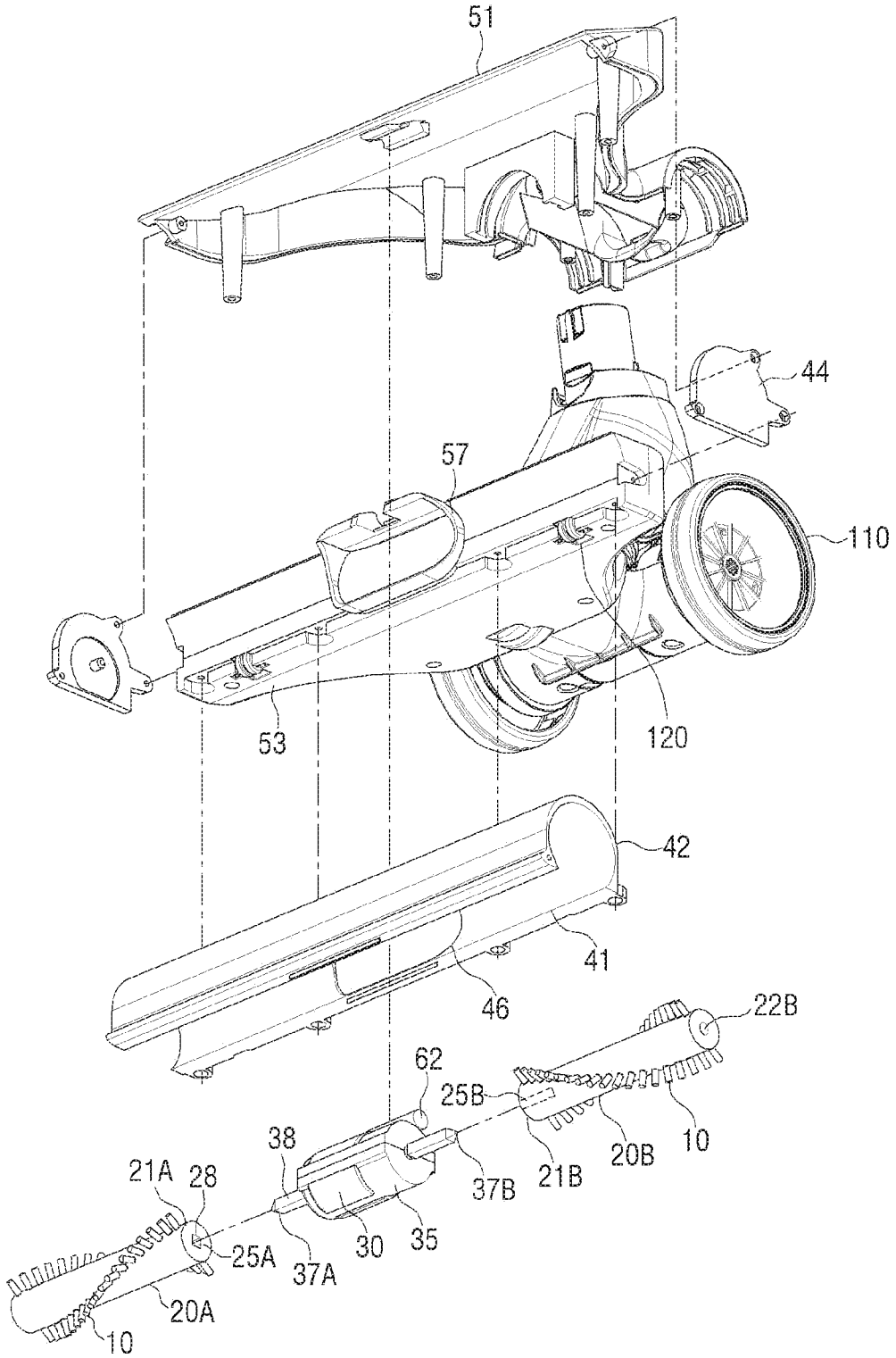
FIG. 3 is an exploded perspective view illustrating the nozzle assembly for a cleaner illustrated in FIG. 2.
Figure 4:
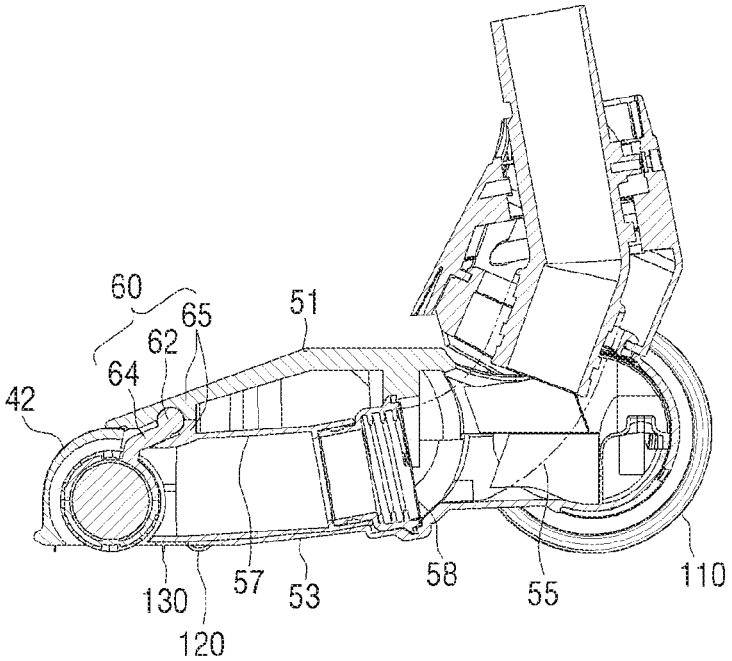
FIG. 4 is a cross-sectional diagram illustrating the nozzle assembly for a cleaner as illustrated in FIG. 2.

FIG. 2 is an enlarged view illustrating the nozzle assembly illustrated in FIG. 1. FIG. 3 is an exploded perspective view illustrating the nozzle assembly illustrated in FIG. 2. FIG. 4 is a cross-sectional diagram illustrating the nozzle assembly as illustrated in FIG. 2. As illustrated in FIGS. 2 to 4, the nozzle assembly 100 may include a first drum 20A and a second drum 20B in which a main brush 10 configured to collect hair, pets' fur, and fiber dust of the surface to be cleaned is installed. The first and second drums 20A and 20B may be installed in an inner front side of the nozzle assembly 100.

The nozzle assembly 100 may include a housing 40 in which a driving member 30 and the first and second drums 20A and 20B are received and a suction port 41 is formed, a cashing 50 which is coupled to a rear side of the housing 40 and provides a flow passage 55 that the air sucked through the suction port 41 flows, and a lifting member 60 which is coupled to the driving member 30 and selectively lifts up a position of the drum.

The casing 50 may include an upper casing 51 coupled to a rear-side top surface of the housing 40 and a lower casing 53 coupled to a rear-side bottom surface of the housing 40. The upper casing 51 and the lower casing 53 may be coupled through a screw and a fixing boss. The housing 40 may be coupled in a state that the upper casing 51 and the lower casing 53 are coupled. The lower casing 53 may be installed to face the surface to be cleaned in cleaning. The flow passage 55 may be formed inside the casing 50 and may be provided through a suction duct 57 and a connection pipe 58 coupled to the suction duct 57.

The housing 40 may include a front housing 42 and side housings 44. The front housing 42 may have a cylindrical shape with both opened lateral surfaces. The suction port 41 may be formed in a bottom surface of the front housing 42 and an opening 46 which communicates with a rear side may be formed in the front housing 42. The opening 46 may provide a passage to which the lifting member 60 to be described later is coupled. The side housings 44 may be installed in both sides of the front housing 42 to close both the opened lateral surfaces of the front housing 42.

The driving member 30 may be a driving motor and may be installed in a central portion of the front housing 42. A first driving shaft 37A and a second driving shaft 37B may be coupled to both sides of the driving member 30 and may be rotated by driving force of the driving member 30. The driving member 30 may be mounted on the motor housing 35 and the first driving shaft 37A and the second driving shaft 37B may protrude from the motor housing 35.

The first drum 20A and the second drum 20B may have a cylindrical shape, and the main brush 10 may be implanted to form one or more spiral trajectories along the outer circumferences of the first drum 20A and the second drum 20B. The main brush 10 may be formed of natural bristles or a material having a low coefficient of friction and good wear-resistance, for example, polyamide (nylon) and the like.

The main brush 10 may be formed to protrude by a fixed length toward the outside of the suction port 41 and in rotation of the first drum 20A and the second drum 20B, the main brush 10 may allow the foreign materials attached to the surface to be cleaned to be easily detached from the surface to be cleaned. For example, in response to the surface to be cleaned being a fiber material such as carpet, the cleaning efficiency may be improved by the main brush 10.

The first drum 20A may have a first coupling surface 21A facing the driving member 30 and the second drum 20B may have a second coupling surface 21B facing the driving member 30. A first insertion groove 25A into which the first driving shaft 37A is inserted may be formed in the first coupling surface 21A and a second insertion groove 25B into which the second driving shaft 37B is inserted may be formed in the second coupling surface 21B. The first driving shaft 37A and the second driving shaft 37B may have one or more driving surfaces 38 which are formed in a depressed form in parallel to each other along a longitudinal direction. One or more driven surfaces 28 corresponding to the driving surfaces 38 may be formed in the first insertion groove 25A. Although not shown in drawings, the second insertion groove 25B may have one or more driven surfaces 28 corresponding to the driving surfaces 38.

For example, as illustrated in FIG. 3, the first driving shaft 37A and the second driving shaft 37B may have a square pillar shape having four driving surfaces 38. The first insertion groove 25A and the second insertion groove 25B may have a square-shaped cross-section corresponding to the first driving shaft 37A and the second driving shaft 37B and the first driving shaft 37A and the second driving shaft 37B may effectively receive driving force in a state that the first driving shaft 37A and the second driving shaft 37B are inserted into the first insertion groove 25A and the second insertion groove 25B.

The lifting member 60 may include a pivot shaft 62 installed to be spaced from the motor housing 35 (or the driving member), a supporting member 65 configured to rotatably support the pivot shaft 62, and a connection member 64 coupled to the pivot shaft 62 and the motor housing 35. A structure and operation of the lifting member 60 will be described in detail below with reference to the following drawings.

Figure 5:
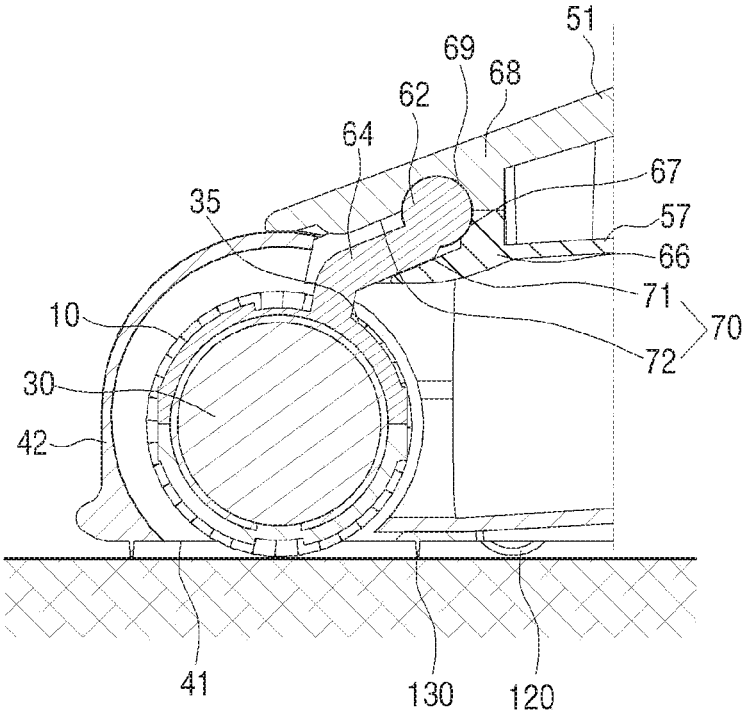
FIGS. 5 and 6 are illustrative diagrams illustrating an operation state of a lifting member illustrated in FIG. 4.
Figure 6:
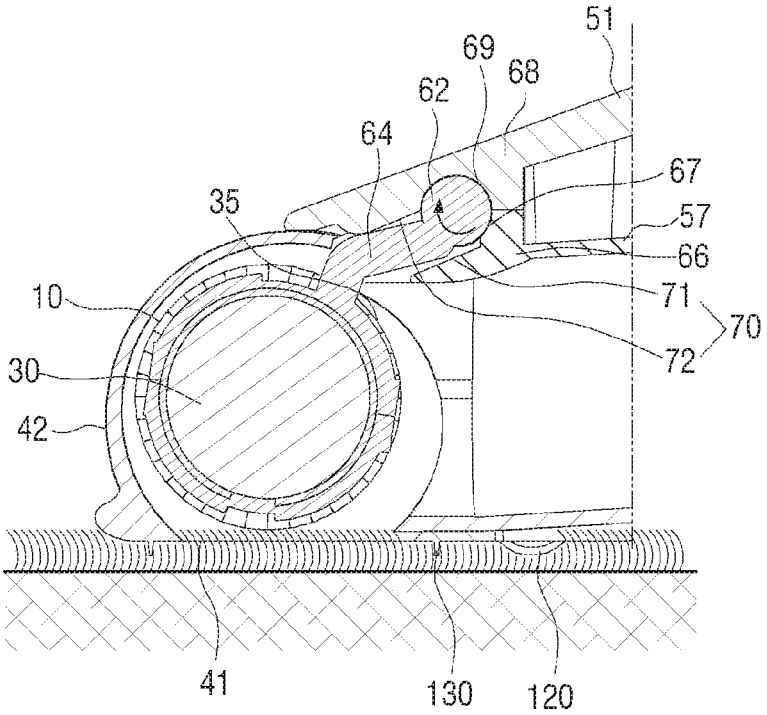

FIGS. 5 and 6 are illustrative diagrams illustrating an operation state of the lifting member illustrated in FIG. 4. As illustrated in FIG. 5, the pivot shaft 62 may have a cylindrical shape corresponding to the motor housing 35. The supporting member 65 may have a first supporting portion 66 and a second supporting portion 68. For example, the pivot shaft 62 may be supported by the first supporting portion 66 which protrudes from a top surface of the suction duct 57 and the second supporting portion 68 which protrudes from a bottom surface of the upper casing 51.

A first depressed portion 67 having a semicircular cross-section may be formed on the first supporting portion 66 and a second depressed portion 69 having a cross-section corresponding to the first depressed portion 67 may be formed on the second supporting portion 68. The pivot shaft 62 may be coupled to the upper casing 51 in a state that the pivot shaft 62 is placed in the first depressed portion 67 and may be disposed between the first depressed portion 67 and the second depressed portion 69. The pivot shaft 62 may be supported by the first supporting portion 66 and the second supporting portion 68 to prevent departure and to be rotatably coupled thereto.

The connection member 64 may be coupled to the motor housing 35 and the pivot shaft 62 and the connection member 64 may be installed in central portions of the pivot shaft 62 and the motor housing 35. The connection member 64 may be a plate having a top surface and a bottom surface.

A position regulation member 70 may be formed to protrude between the first supporting portion 66 and the motor housing 35 and between the second supporting portion 68 and the motor housing 35. The position regulation member 70 may include a seating surface 71 which is arranged in front of the supporting portion 66 and a bottom surface of the connection member 64 is placed therein and a supporting surface 72 which is arranged in front of the second supporting member 68 and suppress the movement of the connection member 64.

The seating surface 71 and the supporting surface 72 may be substantially arranged in parallel to each other and the seating surface 71 and the supporting surface 72 may be arranged to be spaced at a preset interval. The seating surface 71 and the supporting surface 72 may be arranged so that an interval between the seating surface 71 and the supporting surface 72 may be larger than a thickness of the connection member 64 and the connection member 64 may move between the seating surface 71 and the supporting surface 72.

In response to the surface to be cleaned being a hard floor, for example, the surface to be cleaned being a smooth surface configured of stone, wood, or a flooring material, the surface to be cleaned may be easily cleaned in a state (for example, a stand-by position) that the connection member 64 is supported in the seating surface by weights of the driving member 30 and the first and second drums 20A and 20B.

As illustrated in FIG. 6, in response to the surface to be cleaned being carpet, the cleaner may be switched to an operation position that the drum is lifted due to a height of wool densely formed in a top surface of the carpet. For example, the main brushes 10 provided in the first and second drums 20A and 20B may hit the carpet in a state that the main brushes are lifted together with the first and second drums 20A and 20B so that the foreign materials attached to the wool may be effectively detach from the wool and easily sucked.

The loss of the driving force of the driving member 30 may be minimized by controlling the height of the main brush 10 according to the type of surface to be cleaned. For example, the driving member 30 may suppress the overload more than fixed force and the damage of the driving member may be prevented in advance.

The flow passage 55 may be changed to be installed over or below the first driving shaft 37A and the second driving shaft 37B coupled to the driving member 30. An elastic member (not shown) may be interposed between the connection member 64 and the first supporting surface 72 to apply appropriate elastic force toward the surface to be cleaned.

Figure 7:
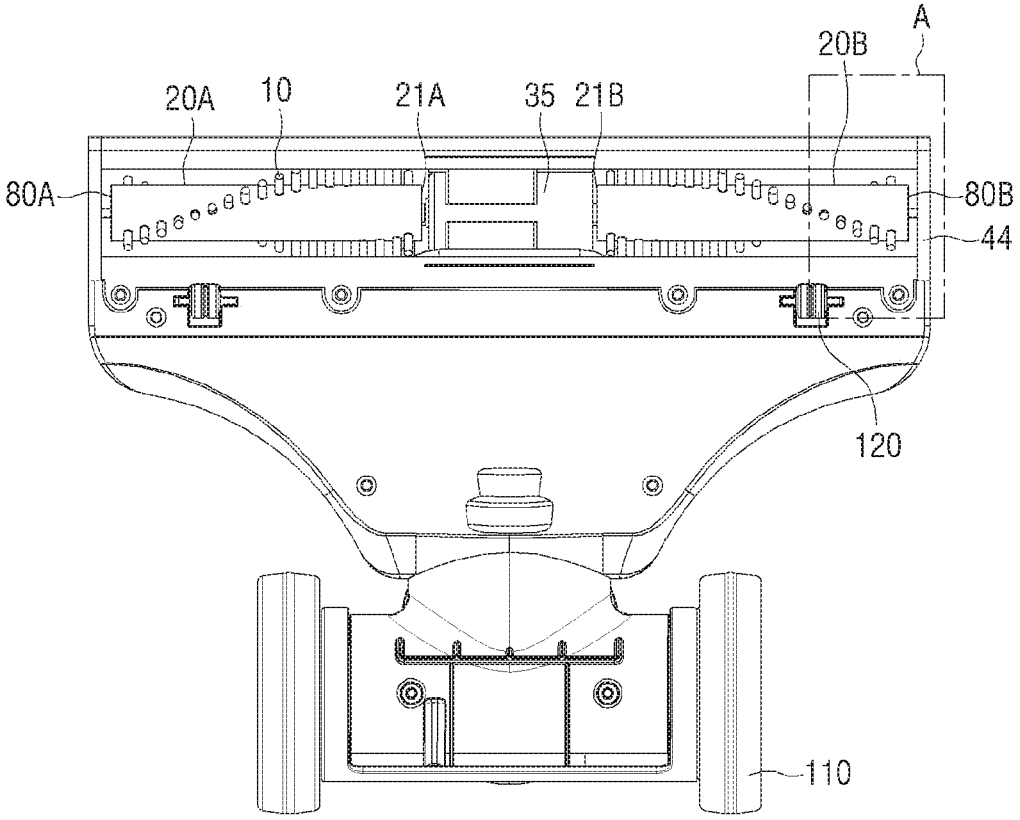
FIG. 7 is a bottom view illustrating the nozzle assembly for a cleaner illustrated in FIG. 2.
Figure 8:
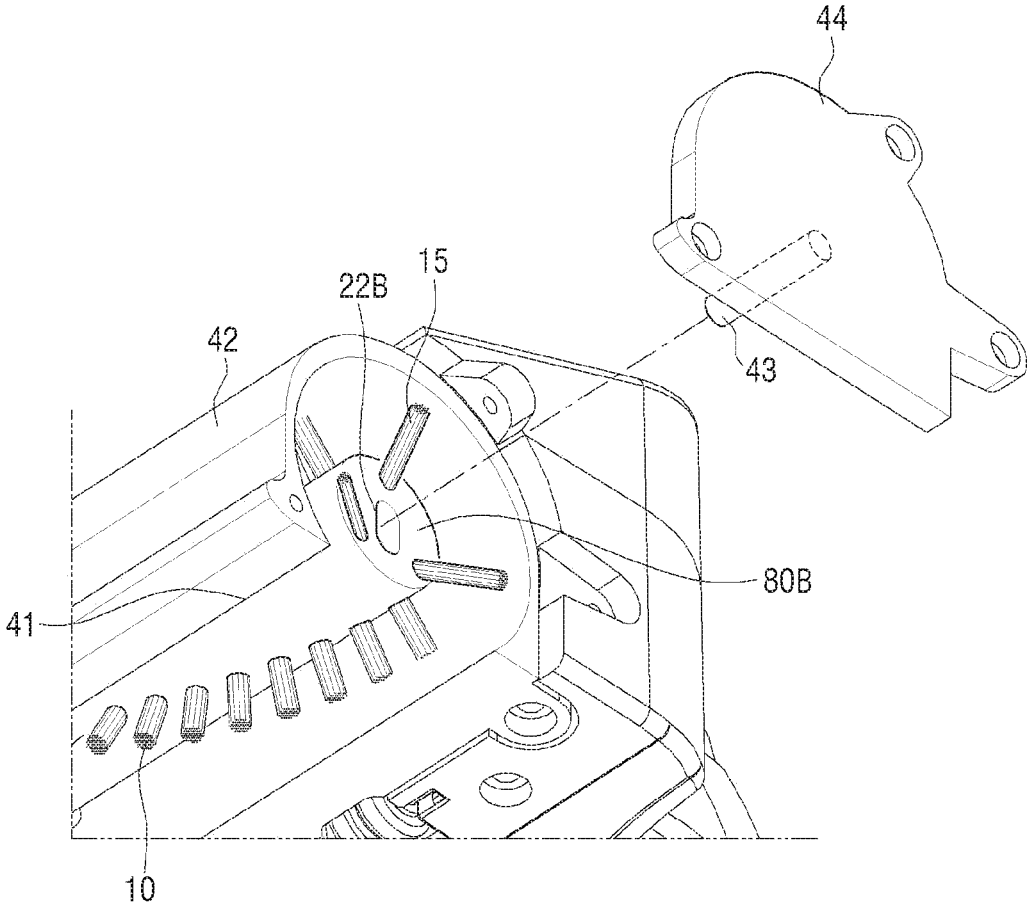
FIG. 8 is an enlarged view illustrating a portion A of the nozzle assembly for a cleaner illustrated in FIG. 7.

FIG. 7 is a bottom view illustrating the nozzle assembly for a cleaner illustrated in FIG. 2. FIG. 8 is an enlarged diagram illustrating a portion A of the nozzle assembly for a cleaner illustrated in FIG. 7. As illustrated in FIGS. 7 and 8, the first drum 20A may have a first installation surface 80A arranged in an opposite side of the first coupling surface 21A and the second drum 20B may have a second installation surface 80B arranged in an opposite side of the second coupling surface 21B. For clarity, the nozzle assembly will be described on the basis of the second installation surface and structures and operations of the first drum 20A and the side housing 44 arranged in one side may correspond to coupling between the second drum 20B and the side housing 44 arranged in the other side.

A second supporting groove 22B may be formed in a depressed form in a central portion of the second installation surface 80B along a longitudinal direction of the second drum 20B. The second installation surface 80B and side housings 44 arranged in the other side may be arranged at a preset interval. A supporting projection 43 may be formed in an inner surface of each side housing 44 and the supporting projection 43 may be formed to protrude in a central portion of the inner surface.

For example, the supporting projection 43 may be inserted to the second supporting groove 22B to rotatably support the second drum 20B. The second supporting groove 22B may be formed to be elongated in a vertical direction so that the second drum 20B is easily lifted according to the type of surface to be cleaned.

An auxiliary brush 15 may be installed in each of the first installation surface 80A and the second installation surface 80B and the auxiliary brushes 15 may be eccentrically disposed from the centers of the first installation surface 80A and the second installation surface 80B. One end portions of the auxiliary brushes 15 may be installed in the first and second drums 20A and 20B and the other end portions of the auxiliary brushes 15 may be disposed to protrude from the outer circumferences of the first and second drums 20A and 20B. The auxiliary brushes 15 may be obliquely disposed toward outer sides of the first and second installation surfaces 80A and 80B from the centers thereof and protrude to the outside of the suction port 41 to be in contact with the surface to be cleaned.

A rib 130 may be installed to protrude in a bottom surface of the lower casing. For example, the rib 130 may be disposed in a front side and a rear side of the suction port 41 and may be installed along a circumference of the suction port to improve the suction force. The rib 130 may be formed of a flexible material to be easily in tight contact with the surface to be cleaned.

Figure 9:
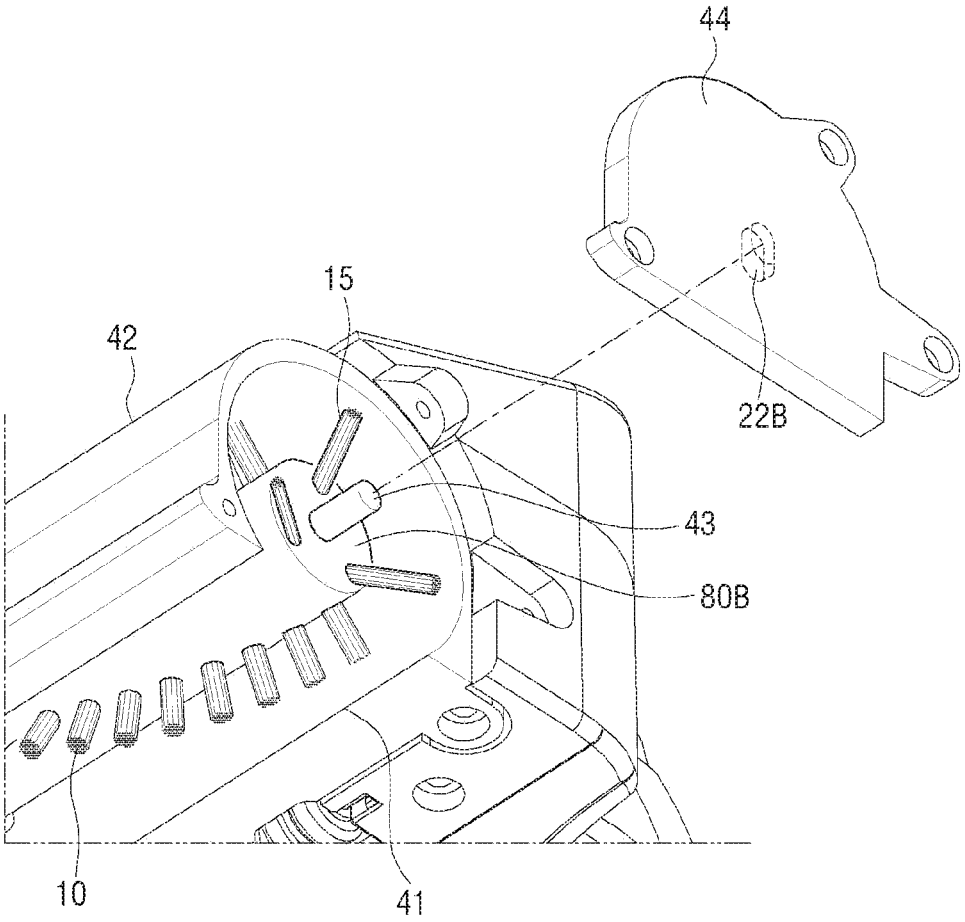
FIG. 9 is a diagram illustrating a modified example of the nozzle assembly illustrated in FIG. 8.

FIG. 9 is a diagram illustrating a modified example of the nozzle assembly illustrated in FIG. 8. As illustrated in FIG. 9, supporting projections 43 may be installed in central portions of the first installation surface 80A and the second installation surface 80B, and the supporting grooves 22B may be formed in a depressed form from the inner surfaces of the side housings 44.

For example, the first drum 20A and the second drum 20B may be rotatably supported to the side housings 44 and the supporting grooves 22B may be formed to be elongated in a vertical direction so that the first drum 20A and the second drum 20B are easily lifted according to the type of surface to be cleaned.

Figure 10:
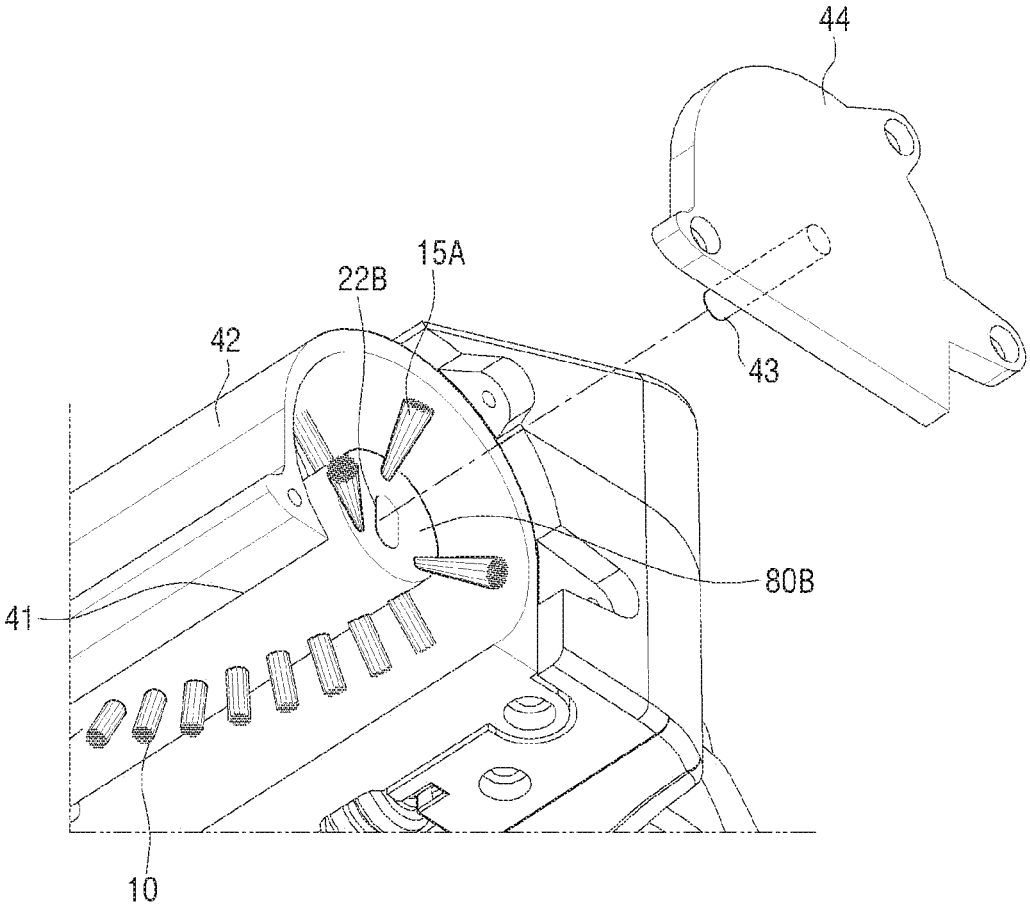
FIG. 10 is a diagram illustrating a modified example of the nozzle assembly illustrated in FIG. 8.

FIG. 10 is a diagram illustrating a modified example of a nozzle assembly illustrated in FIG. 8. As illustrated in FIG. 10, an auxiliary brush 15A may have a truncated shape that a cross-section is increased toward the outer side. The other end portion of the auxiliary brush 15A may have a larger cross-section than one end portion of the auxiliary brush 15A and thus the contact area of the auxiliary brush 15A with the surface to be cleaned and the clean efficiency may be improved.

Figure 11:
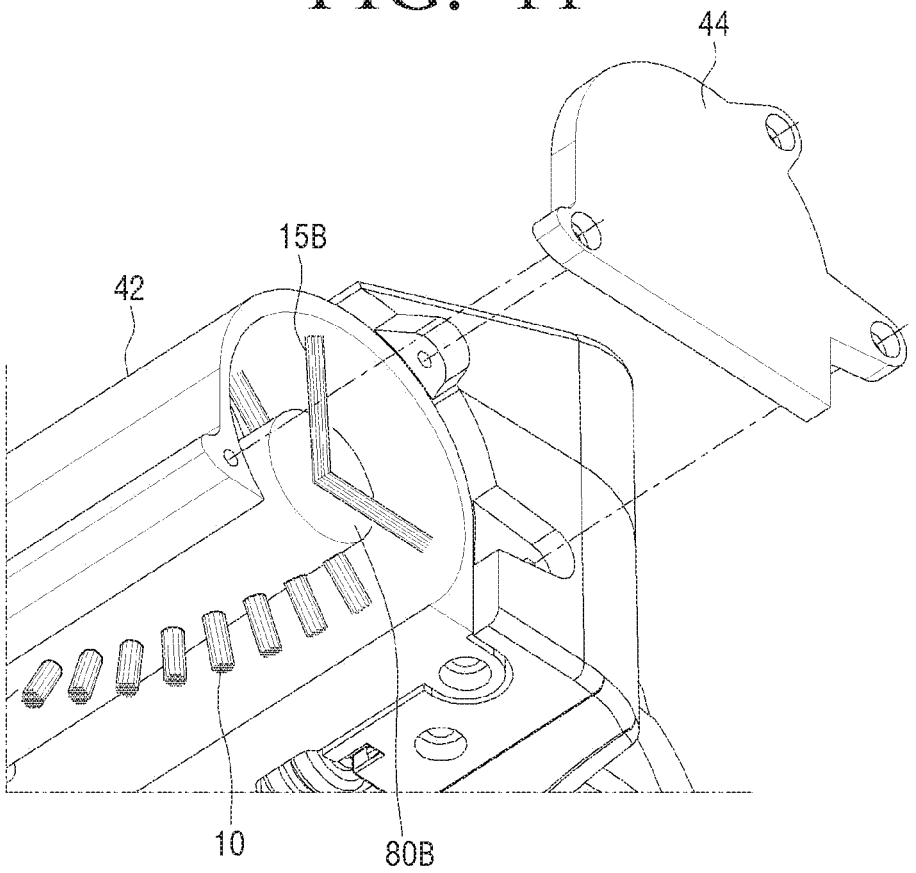
FIG. 11 is a diagram illustrating another modified example of the nozzle assembly illustrated in FIG. 10.

FIG. 11 is a diagram illustrating another modified example of the nozzle assembly illustrated in FIG. 10. As illustrated above, the first installation surface 80A and the side housing 44 disposed in one side may be arranged to be spaced at a preset interval and the second installation surface 80B and the side housing 44 disposed in the other side may be arranged to be spaced at a preset interval. An auxiliary brush 15B may be installed in the central portion of the second installation surface 80B and although not shown in FIG. 11, the auxiliary brush 15B may also be installed in the first drum 20A to be symmetrical with the second drum 20B on the basis of the driving member 30.

One end portions of the auxiliary brushes 15B may be installed in the first installation surface 80A and the second installation surface 80B and the other end portions of the auxiliary brushes 15B may be disposed to protrude from the outer circumferences of the first and second drums 20A and 20B. Accordingly, the auxiliary brushes 15B may be obliquely disposed toward the outer sides of the first and second installation surfaces 80A and 80B from the centers thereof and may protrude to the outside of the suction port 41 to be in contact with the surface to be cleaned.

For example, the first and second drums 20A and 20B which are installed in both sides of the driving member 30 may be easily rotated without separate members configured to support the sides thereof and a cleaning area of the surface to be cleaned may be maximized and thus the surface to be cleaned may be effectively cleaned.

Figure 12:
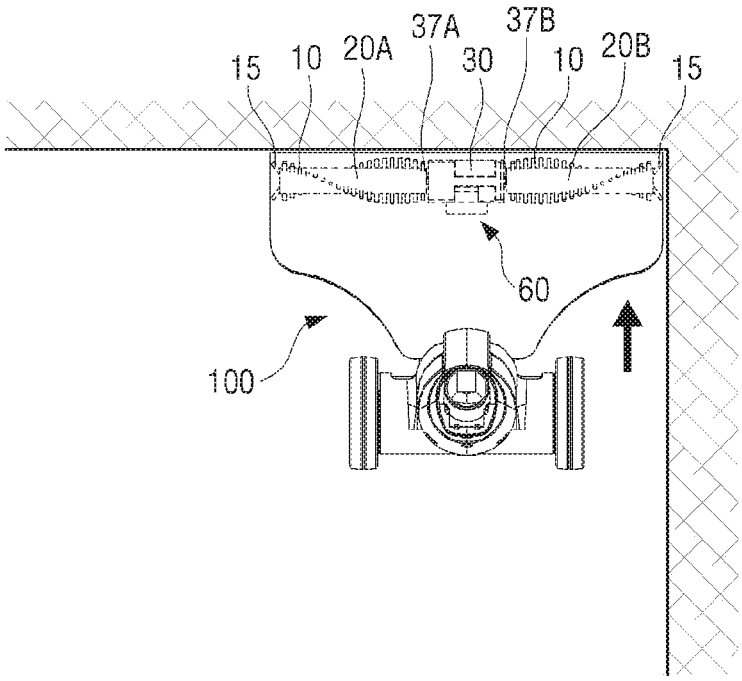
FIG. 12 is a diagram illustrating a use state of a nozzle assembly illustrated in FIG. 2.

FIG. 12 is a diagram illustrating a use state of the nozzle assembly illustrated in FIG. 2. In the nozzle assembly of the related art, driving members configured to drive the drum, for example, a driving motor, a driving gear, a driving transfer member (timing belt), and the like may be installed in both side portions and the clean efficiency for the surface to be cleaned may be degraded.

As illustrated in FIG. 12, the cleaner may be rotatably driven in a state that the cleaner is in tight contact with the wall to the maximum through the first drum 20A and the second drum 20B installed in both sides of the driving member 30 installed in the central portion of the nozzle assembly and thus the cleaner may effectively perform cleaning on a corner portion of the wall.

Since the first and second drums 20A and 20B are directly coupled to the first and second driving shafts 37A and 37B of the driving member 30, the first drum 20A and the second drum 20B may be rotated with minimization of the loss of the driving force. The positions of the first and second drums 20A and 20B may be lifted according to the type of surface to be cleaned through the lifting member 60 provided in the nozzle assembly 100 and thus the surface to be cleaned may be effectively cleaned. The wearing of the main brush 10 and the auxiliary brush 15 which are in direct contact with the surface to be cleaned may be minimized and thus the user lifespan may extend.

Figure 13:
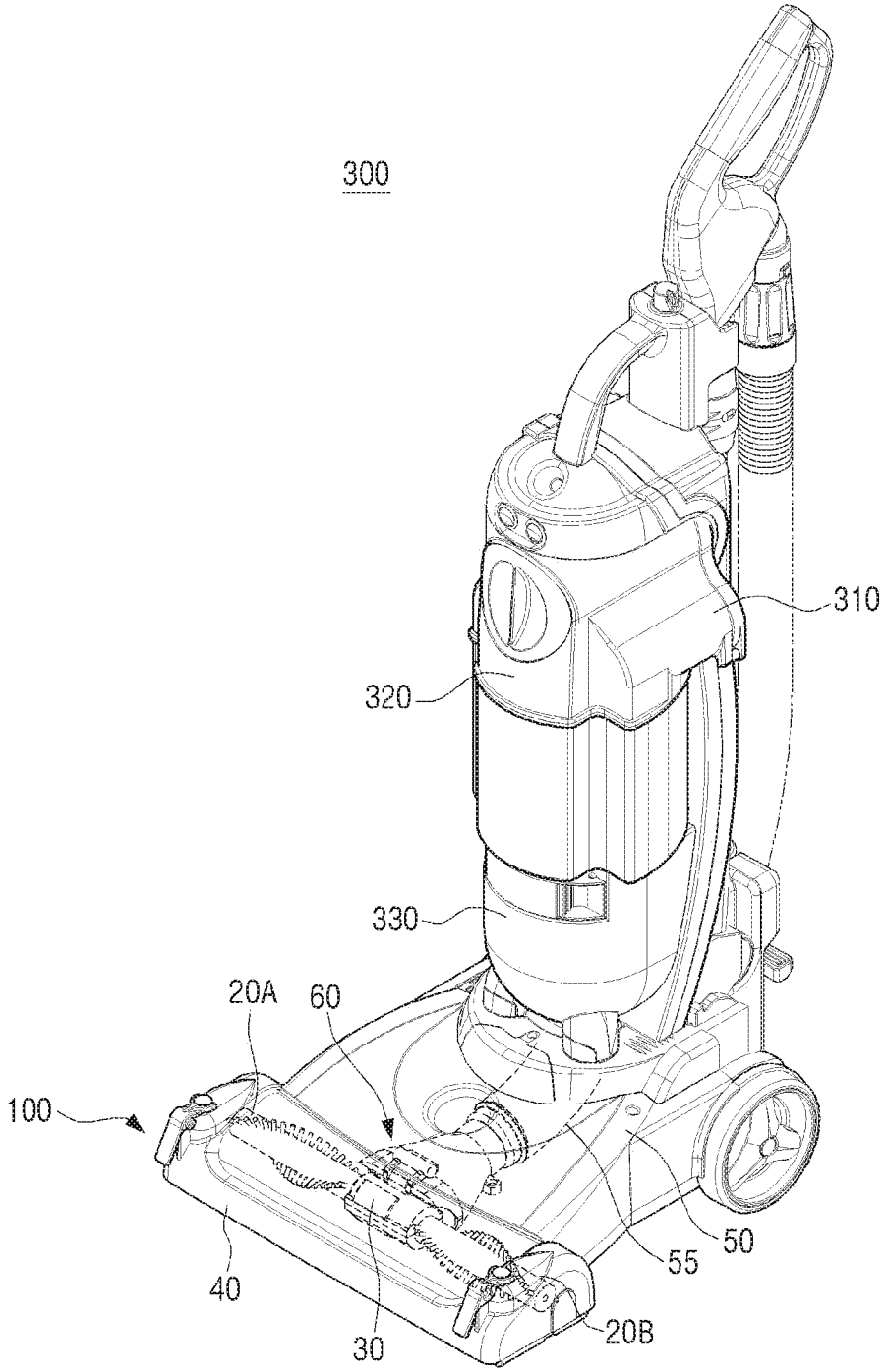
FIG. 13 is a schematic diagram illustrating an upright type cleaner according to another exemplary embodiment.

FIG. 13 is a schematic diagram illustrating an upright type cleaner according to another exemplary embodiment. As illustrated in FIG. 13, an upright type vacuum cleaner 300 may include a main body 310 and a nozzle assembly 100. The main body 310 may include a dust collector 320 configured to separate dirt from the air including the dirt and a vacuum suction motor 330 configured to form negative pressure. The nozzle assembly 100 may be coupled to the main body 310 through a flow passage 55 and the nozzle assembly 100 may suck the dirt of the surface to be cleaned together with the neighboring air using the negative pressure formed in the vacuum suction motor 330 and transfer the sucked dirt to the dust collector 320.

The nozzle assembly 100 may include a housing 40 in which a driving member 30 and first and second drums 20A and 20B are received and a suction port is formed, a casing 50 which is coupled to the rear side of the housing 40 and provide the flow passage 55 that the air sucked through the suction port flow, and a lifting member 60 which is coupled to the driving member 30 and selectively lifts a position of the drum.

The driving member 30 may be a driving motor and may be disposed in a central portion of the housing 40. The first drum 20A and the second drum 20B may be installed in both sides of the driving member 30 to be rotated by the driving force of the driving member 30. The configuration and operation of the nozzle assembly 100 are the same as those of the nozzle assembly illustrated in FIGS. 1 to 12, and thus overlapping description will be omitted.

Although not shown in the drawings, the above-described nozzle assembly may be applied to various types of vacuum cleaners including a small handy cleaner in addition to an upright type cleaner and a canister type cleaner.

The various exemplary embodiments have been separately described, but the exemplary embodiments may not be necessarily separately implemented and the configuration and operation of each exemplary embodiment may be implemented by combining at least one other exemplary embodiment.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A nozzle assembly for a vacuum cleaner comprising:

a driving member including a first driving shaft and a second driving shaft in both sides thereof;

a first drum of which one end is coupled to the first driving shaft;

a second drum of which one end is coupled to the second driving shaft;

a front housing which receives the driving member and the first drum and the second drum and has a suction port configured to suck air in a bottom surface thereof; and side housings which close both opened side portions of the front housing, wherein first and second installation surfaces are spaced from the side housings at a predetermined interval.

2. The nozzle assembly for a vacuum cleaner as claimed in claim 1, wherein the first drum has a first insertion groove which is concavely formed in a first coupling surface facing the driving member, wherein the second drum has a second insertion groove which is concavely formed in a second coupling surface facing the driving member, wherein the first driving shaft is inserted into the first insertion groove, and wherein the second driving shaft is inserted into the second insertion groove.

3. The nozzle assembly for a vacuum cleaner as claimed in claim 2, wherein the first driving shaft and the second driving shaft have driving surfaces formed in outer circumferences thereof, and wherein the first insertion groove and the second insertion groove have driven surfaces which are rotatably supported to the driving surfaces.

4. The nozzle assembly for a vacuum cleaner as claimed in claim 2, wherein the first drum and the second drum include:

main brushes installed in outer circumferences thereof; and auxiliary brushes installed in the first and second installation surfaces are arranged in opposite sides of the first coupling surface and the second coupling surface.

5. The nozzle assembly for a vacuum cleaner as claimed in claim 1, wherein the auxiliary brushes are installed in central portions of the first and second installation surfaces and are obliquely arranged to protrude from the outer circumferences of the first drum and the second drum.

6. The nozzle assembly for a vacuum cleaner as claimed in claim 1, further comprising:

a lifting member coupled to the driving member and configured to selectively lift up positions of the first drum and the second drum, wherein the lifting member includes:

a pivot shaft disposed in parallel to an axis direction of the driving member;

a supporting member configured to rotatably support the pivot shaft; and a connection member fixedly installed to the pivot shaft and the driving member.

7. A nozzle assembly comprising:

a driving member;

a pair of drums arranged in both sides of the driving member and configured to be rotated through driving force of the driving member; and a lifting member coupled to the driving member and configured to selectively lift up positions of the pair of drums.

8. The nozzle assembly for a vacuum cleaner as claimed in claim 7, wherein the lifting member includes:

a pivot shaft disposed in parallel to an axis direction of the driving member;

a supporting member configured to rotatably support the pivot shaft; and a connection member fixedly installed to the pivot shaft and the driving member.

9. The nozzle assembly for a vacuum cleaner as claimed in claim 8, wherein the lifting member further includes a position regulating member having a seating surface in which a bottom surface of the connection member is placed and a supporting surface which is arranged over the seating surface to be spaced from the seating surface and is in contact with a top surface of the connection member.

10. The nozzle assembly for a vacuum cleaner as claimed in claim 9, wherein an interval between the seating surface and the supporting surface is larger than a thickness of the connection member.

11. The nozzle assembly for a vacuum cleaner as claimed in claim 9, wherein a drum is switched between a first position in which the bottom surface of the connection member is in contact with the seating surface and a second position in which the bottom surface of the connection member is in noncontact with the seating surface according to a type of surface to be cleaned.

12. The nozzle assembly for a vacuum cleaner as claimed in claim 7, further comprising:

a housing which receives the driving member and the pairs of drums and has a suction port configured to suck air in a bottom surface thereof, wherein each of the pair of drums includes an auxiliary brush installed in one surface arranged in an opposite side of the driving member.

13. The nozzle assembly for a vacuum cleaner as claimed in claim 12, wherein the housing includes:

a front housing has a suction port and has a both-side opened cylindrical shape; and side housings installed in both sides of the front housing, wherein the one surfaces of the pair of drums are arranged to be spaced from inner surfaces of the side housings at a predetermined interval.

14. The nozzle assembly for a vacuum cleaner as claimed in claim 13, wherein the auxiliary brush is installed in a central portion of the one surface of a drum and is obliquely arranged to protrude from an outer circumference of the drum.

15. The nozzle assembly for a vacuum cleaner as claimed in claim 14, wherein each of the pair of drums has a supporting projection which is formed to protrude in the central portion of the one surface of the drum, and wherein each of the side housings has an elongated supporting groove which the supporting projection is inserted thereinto and corresponds to a lifting direction of the drum.

16. The nozzle assembly for a vacuum cleaner as claimed in claim 13, wherein each of the side housings has a supporting projection which is formed to protrude from the inner surface of the side housing, and wherein each of the pairs of drums has an elongated supporting groove, which the supporting projection is inserted thereinto and corresponds to a lifting direction of a drum, in a central portion of the one surface of the drum.

17. The nozzle assembly for a vacuum cleaner as claimed in claim 12, wherein one end portion of the auxiliary brush is installed in a drum and the other end portion of the auxiliary brush has a larger cross-section area than the one end portion of the auxiliary brush.

18. A vacuum cleaner comprising:

a main body in which a dust collector is installed;

a nozzle assembly; and a flexible hose which couples the main body and the nozzle assembly, wherein the nozzle assembly includes:

a driving member, a pair of drums coupled to both sides of the driving member to be driven through driving force of the driving member, and a lifting member coupled to the driving member and configured to selectively lift up positions of the pair of drums.

* * * * *